US006289656B1

(12) United States Patent
Wangu et al.

(10) Patent No.: US 6,289,656 B1
(45) Date of Patent: Sep. 18, 2001

(54) PACKAGING MACHINE

(75) Inventors: Manoj K. Wangu, Wexford, PA (US); Frederick Pfleger, Voorhees, NJ (US); Paul J. Eachus, Pittsgrove, NJ (US); Michele L. Porcelli, Jr., Gloucester City, NJ (US)

(73) Assignees: McKesson Automated Healthcare, Inc., Pittsburgh, PA (US); FP Developments, Inc., Williamstown, NJ (US)

( * ) Notice: Subject to any disclaimer, the term of this patent is extended or adjusted under 35 U.S.C. 154(b) by 0 days.

(21) Appl. No.: 09/614,969

(22) Filed: Jul. 12, 2000

(51) Int. Cl.[7] ..... B65B 57/00
(52) U.S. Cl. ..... 53/507; 53/540
(58) Field of Search ..... 53/158, 412, 540, 53/374.3, 547, 201, 548, 562, 568; 206/462; 414/273

(56) References Cited

U.S. PATENT DOCUMENTS

| | | | | |
|---|---|---|---|---|
| 5,593,267 | * | 1/1997 | McDonald et al. | 414/273 |
| 5,771,662 | * | 6/1998 | Struges et al. | 53/412 |
| 5,826,411 | * | 10/1998 | Butturini | 53/568 |
| 5,839,257 | | 11/1998 | Soderstrom et al. | 53/131.5 |
| 5,842,320 | * | 12/1998 | Chiu | 53/201 |
| 5,845,465 | * | 12/1998 | Bennett | 53/374.3 |
| 5,878,885 | * | 3/1999 | Wangu et al. | 206/462 |

OTHER PUBLICATIONS

Medical Packaging, Inc. brochure "Auto–Print Unit Dose Packaging" (date unknown).
Medical Pkg., Inc. package having expiration date Dec. 15, 1998.

* cited by examiner

*Primary Examiner*—Peter Vo
*Assistant Examiner*—Chukwurah Nathaniel
(74) *Attorney, Agent, or Firm*—Buchanan Ingersoll, P.C.

(57) ABSTRACT

A packaging machine for enclosing items in a package delivers individual items, such as medicine, through a feeder that disposes the item between two strips of packaging material which are then joined together around the item by a closure member thus sealing the item in an individual package. The packaging machine demarcates upper and lower boundaries about the item such that the enclosed item may be separated from a continuously produced strand of packages. The packaging machine includes a selectively operable hole punch portion disposed adjacent the strand of packages for providing a hole in a portion of each package. The hole punch portion includes a punch driving member which is disengable responsive to unexpected resistance encountered by the punch. A cutter/stacker portion adjacent the strand of separable packages separates the strand into individual packages and stacks the packages in a removable magazine. The magazine has a rod member onto which the packages are inserted with the rod member extending through the hole in each package. A printer can be included for printing indicia on one side of one of the continuously fed strips of packaging material to provide information regarding the enclosed item.

27 Claims, 6 Drawing Sheets

FIG. 6
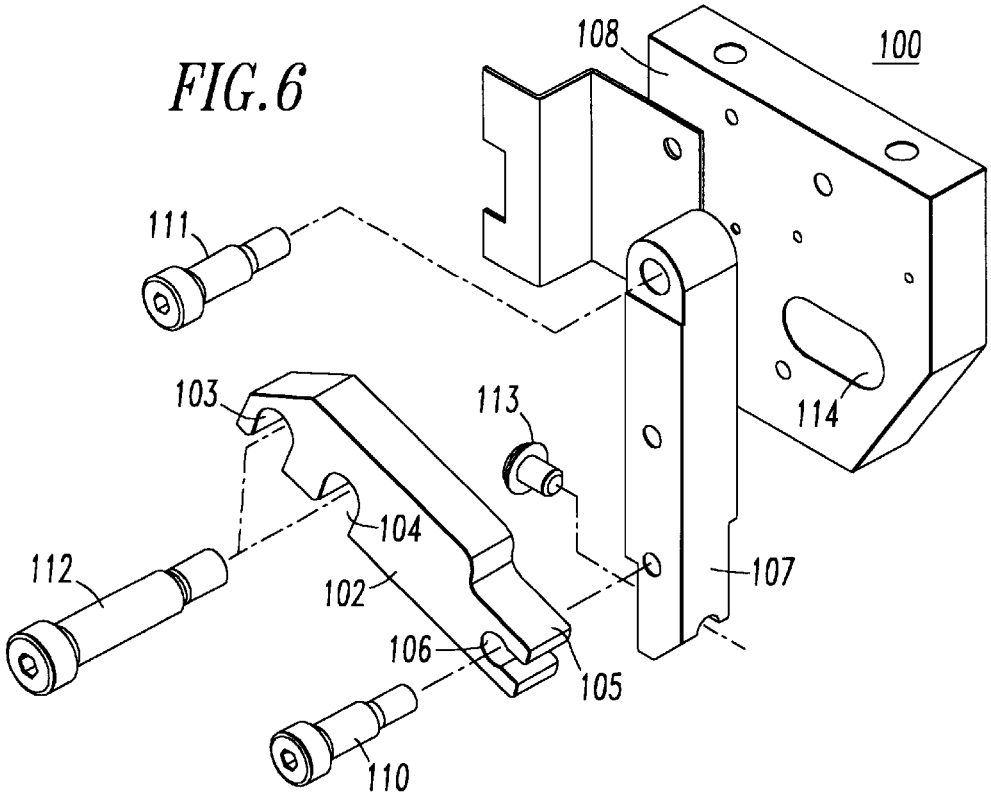
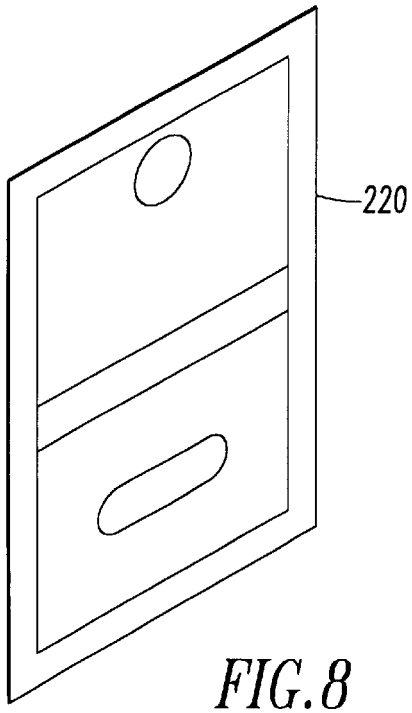
FIG. 8
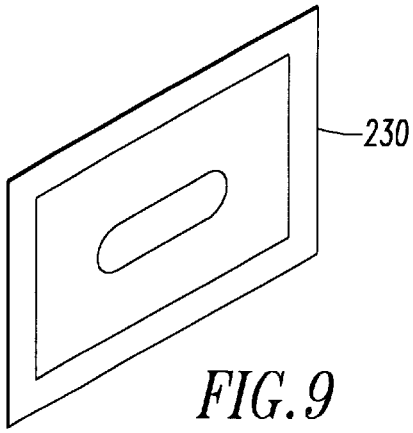
FIG. 9

PACKAGING MACHINE

BACKGROUND

This invention relates generally to packaging machines which enclose items between strips of material and, more particularly, to a packaging machine for enclosing medicine in packages which can be separated and stored in a removable magazine.

Bulk packaging machines which can separate and individually package a quantity of items and produce individual packages are known in the art, particularly bulk packaging machines which have been heretofore used to package medicine, such as capsules, caplets and tablets. One such prior art pill packaging machine can be used to separate and individually package large quantities medicines such as tablets or capsules. This bulk packing machine includes components demarcating upper and lower boundaries of packages, such as by scoring or perforating, such that a strand of individually separable packages are produced which can later be manually separated. Such a bulk packaging machine includes a top tray portion for separating a quantity of loose capsules, tablets, or other solid items, into individualized compartments and feeding each capsule individually, such as through a chute, into a position where it can be individually enclosed in a sealed package. Of course, the tray portion could also be configured to separate the loose capsules into pairs, or larger groups. Generally, two rolls of packaging material are positioned at opposite ends of the bulk packaging machine and are fed towards each other into an adjacent relationship at a packaging portion of the bulk packaging machine. At the packaging portion, the two strips of material are brought together in an adjacent position and joined together about a perimeter of the item to create an individual package. The packaging portion has a closure member, which is a generally horseshoe shaped fixed frame on one side of the packaging portion and a correspondingly shaped movable frame positioned opposite the fixed frame for movement against the fixed frame. Either or both the fixed frame or the movable frame can be heated. When the movable frame is moved into contact with the fixed frame, with the two strips of packaging material sandwiched therebetween, the packaging material will be joined together by pressure and heat. The bulk packaging machine can further include a control unit for operating the device and a printer for printing information on one side of one of the strips of packaging material which is indicative of the type of medicine enclosed.

A disadvantage of the prior art bulk packaging machines is that the individual packages must be manually separated from the continuous strand of packages produced. Furthermore, packages made on such machines have been sealed around the edges having little room to punch a hole through the package without opening the pocket containing the pill or capsule, or being too close to the edge. Consequently, such packages are not suitable for punching and hence, cannot be stored on a rack. Therefore, they cannot be handled by an automated pharmacy such as is disclosed in U.S. Pat. No. 5,593,267. In an automated pharmacy there is also a need for the hole to be in an accurate location with reference to the formatted barcode. Accordingly, there is a need for a bulk packaging machine which can simultaneously produce a strand of enclosed packages, punch a hole through each individual package in an accurate location with reference to formatted barcode, separate the individual packages from the strand, and store separated packages in a magazine. Moreover, this packaging machine should be designed so that if the pill or other object being packaged does not fall completely into the package and is struck by the by the punch, components of the punch driving mechanism will release preventing damage to the punch. Should this occur, the punch driving mechanism should be easily reset to avoid a lengthy shut down of the machine.

SUMMARY

A packaging machine is provided for enclosing items in a package and then separating and storing the packages in a magazine. The packaging machine delivers individual items, such as medicine, through a feeder that disposes the item between two strips of packaging material. A closure member then joins the two strips of packaging material together around the item, thus sealing the item in an individual package. The packaging machine also has a demarcating member which demarcates upper and lower boundaries about the item such that the enclosed item may be separated from a continuously produced strand of packages. The packaging machine also includes a magazine for storing individual separated packages, a hole punch member, a separator member, a stacker member, and a magazine wherein the separated packages are stored. The hole punch member is disposed adjacent the strand of packages for punching a hole in a portion of each package. The hole punch member preferably includes a driving arm portion which is frictionally engaged with a member that drives the punch. The frictional engagement is designed such that if the punch encounters a certain degree of resistance, such as from striking a relatively hard object, disengagement of the driving arm and the member that drives the punch will occur without damage to any components. Operation can then be more quickly resumed since the only repair necessary is to re-engage the disengaged members. The separator member is located adjacent the strand of separable packages and the stacker member. The separator member separates the strand into individual packages which are then placed in the magazine by the stacker member. The magazine, which is preferably removable, includes a rod member on which the stacker member inserts the packages, with the rod member extending through the hole provided in each package by the hole punch member. A printer and a printer control unit can also be included for printing indicia on one side of one of the continuously fed strips of packaging material to provide information regarding the enclosed item.

Other details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings, in which:

FIG. 6 is an exploded view of a presently preferred hole punch linkage used in the embodiment shown in FIGS. 2 and 3.

FIG. 8 is a perspective view of a larger package produced by the bulk packaging machine shown in FIGS. 2 and 3.

FIG. 9 is a perspective view of a small package produced by the bulk packaging machine shown in FIGS. 2 and 3.

DETAILED DESCRIPTION OF CERTAIN EMBODIMENTS

Figure 1:
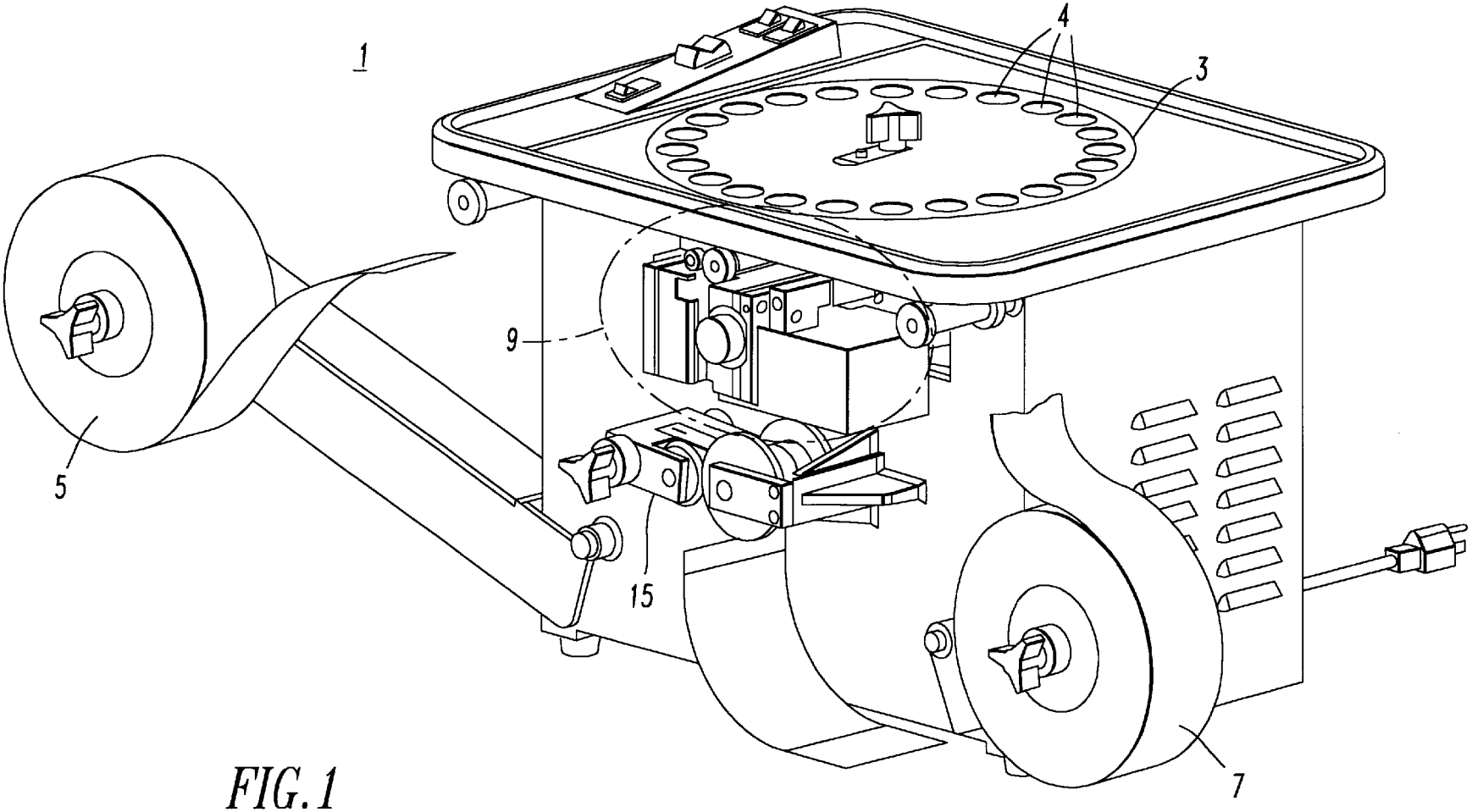
FIG. 1 PRIOR ART
FIG. 1 shows a prior art bulk packaging machine.

To aid in understanding the presently preferred embodiments it will be helpful to first describe a prior art bulk packaging machine and, more particularly, a bulk packaging machine which has been heretofore used to package medicine, such as capsules and tablets. Referring to FIG. 1, there is shown such a prior art bulk packaging machine 1 for enclosing items, such as capsules and tablets, in separately enclosed packages which may be produced in bulk. The bulk packaging machine 1 can score, or perforate, upper and lower boundaries of the enclosed items such that a continuous strand of individually separable packages is produced. The packaging machine 1 also has a top tray portion 3 for separating a quantity of loose items into individualized compartments 4 to thereby separately feed each item, such as through a chute, into a position where it can be individually enclosed in a sealed package. The tray portion 3 could also be configured to separate the loose items into pairs, or larger groups. Also shown are two supplies of packaging material, such as the rolls of packaging strips 5, 7 positioned at opposite ends of the bulk packaging machine 1. The two strips of packaging material 5, 7 are fed towards each other into an adjacent relationship at a packaging portion 9 of the bulk packaging machine 1. At the packaging portion 9, the two strips of packaging material 5, 7 are brought together into an adjacent relationship and then sealed together to enclose the items in individual packages. The packaging portion 9 typically includes a closure member, such as a generally horse-shoe or A-shape fixed frame on one side of the packaging portion 9 and a correspondingly shaped movable frame positioned opposite the fixed frame for movement thereagainst. Either the fixed frame or the movable frame, or both, can be heated so that when the movable frame is moved into contacts with the fixed frame, with the two strips of packaging material 5, 7 sandwiched therebetween, the two strips of packaging material 5, 7 will be joined together along the edges which are pressed together and heated by the two frame members. In this manner, the two strips of packaging material 5, 7 are joined together along a perimeter and across the center thereby enclosing the item in a package.

The bulk packaging machine 1 can also include a printer and a control unit (neither shown). The control unit may be programmable and may be used to control one or both of the bulk packaging machine 1 and the printer. The printer can be employed to print information on a side of one of the strips of packaging material 5, 7. Information regarding the packaged item can be stored in the control unit, or in printer memory if available, and the printer 13 can print such information on the side of one of the strips of packaging material 5, 7. The bulk packaging machine 1 can also include a cutter or a demarcating portion 15, which can cut, perforate or score the joined together strips of packaging material at upper and lower boundaries of the enclosed items. Scored or perforated strips of packages of enclosed items may be manually separated into individual packages by tearing the continuously produced strand of packages along the perforations or score lines. Although the bulk packaging machine 1 may have various other features or modifications, those features described above are typical of the primary components of prior art bulk packaging machines.

Figure 2:
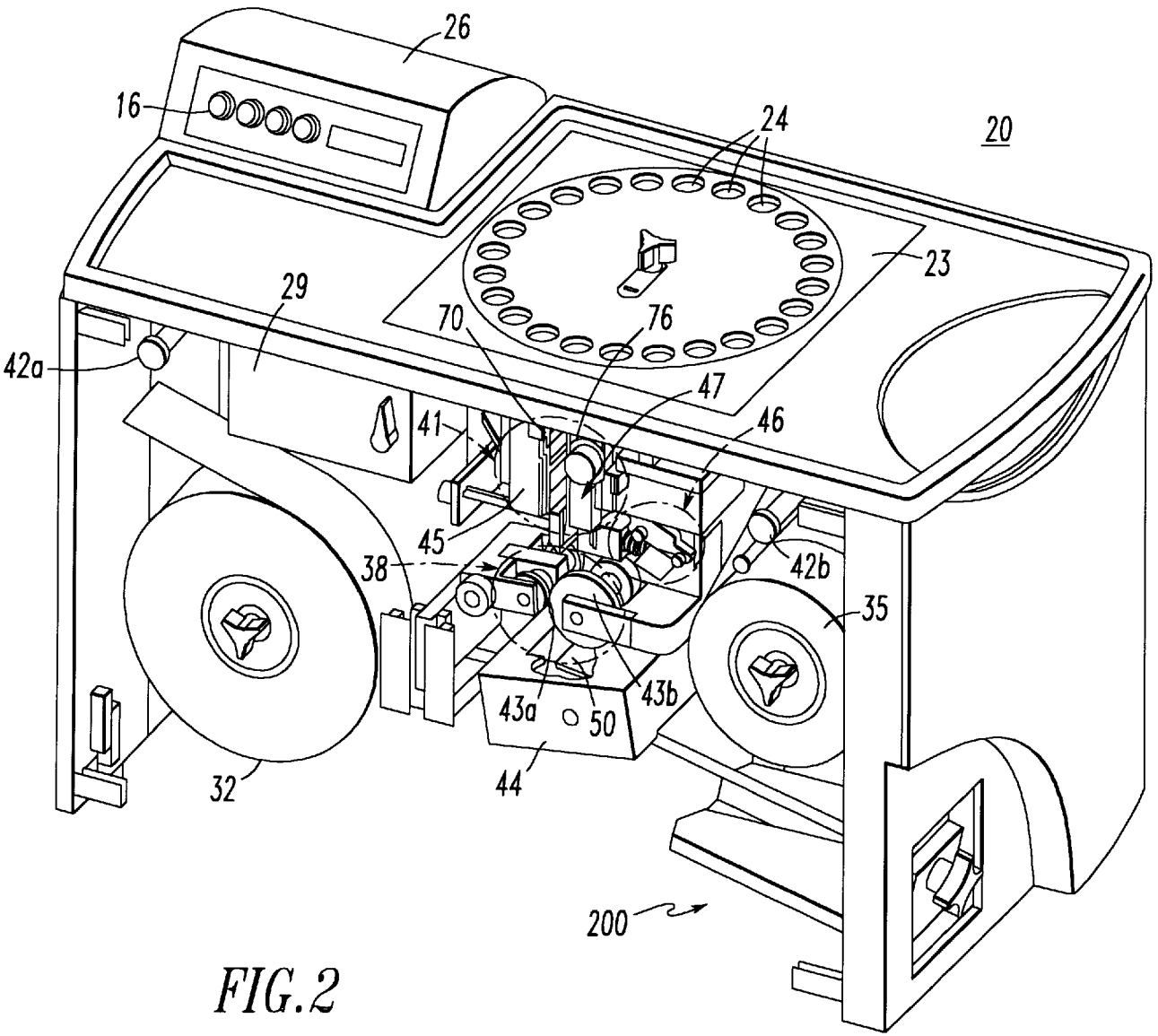
FIG. 2 is a front perspective view of a presently preferred embodiment of the bulk packaging machine of the present invention with the front panel removed.
Figure 3:
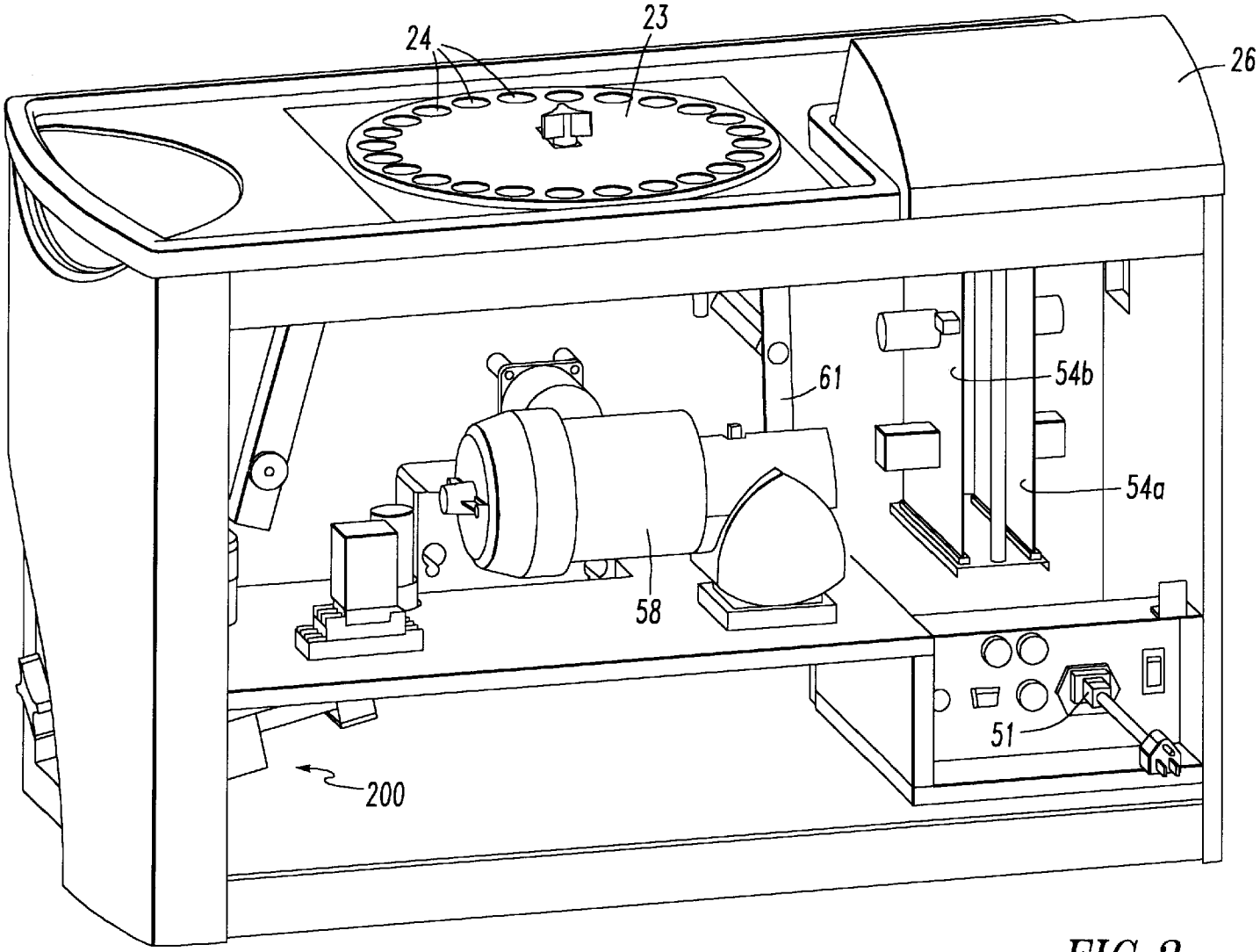
FIG. 3 is a rear perspective view of the bulk packaging machine shown in FIG. 2 with the rear panel removed.

Referring now to FIGS. 2 and 3, there is shown a presently preferred embodiment of a packaging machine 20 which, in addition to several new features, may include most, or all, of the conventional components of the prior art bulk packaging machine 1 described in connection with FIG. 1, such as a display and control unit 26, which may be programmable, and a printer 29. Additionally, the packaging machine 20 includes a top tray portion 23 which separates a quantity of loose items to be enclosed in individual packages. The items are separated, by vibrating the top tray portion 23 or manually placing the items into individual compartments 24 of the top tray 23, which individually deliver the items, for example, through chutes communicating with the underside of compartments 24, to a packaging portion 41. It should be understood that the items can also be separated into groups of two, or more, instead of individually. Typically, two supplies of packaging material, such as rolls 32 and 35 containing strips of packaging material, are fed towards the packaging portion 41, such as by a series of rollers, including rollers 42*a*, 42*b*. The packaging machine 20 may also include a feeder portion 38, having roller 43*a* and 43*b*, which may be powered. The rollers, including 43*a*, 43*b*, 42*a*, and 42*b*, draw and guide the two strips of packaging material 32, 35 into an adjacent relationship through the packaging portion 41. The packaging portion 41 further includes a closure portion 45 having die set members 70 and 76, shown in FIG. 4, and a heater unit 47 shown in FIG. 2. The movable die 70 is shown in more detail in FIG. 4. The bulk packaging machine also includes a hole punch portion 46, having a hole punch 80 and hole punch driving portion 100, shown in FIGS. 5 and 6 respectively. The printer 29 prints indicia on at least one side of at least one of the strip of packaging material 32. This indicia usually would include a bar code and other information about the item which is enclosed in the package.

The packaging portion 41 shown also includes a demarcating member 50 which preferably is designed to cut, but can also be suitably designed to score or perforate, the joined together packaging material at upper and lower boundaries of the enclosed item. The packages can thus be separated automatically, or a strand of individually separable packages of enclosed items can be produced. The packaging machine 20 shown also includes a cutter/stacker portion 44 and an associated magazine 200. The cutter/stacker portion 44 is positioned along the feed path of the strand of enclosed items, at a location subsequent to the demarcating member 50. The cutter/stacker portion 44 separates the strand into individual packages. The demarcating member 50 can simply be a blade which cuts, such as by a scissor-type action, the joined together packaging material about upper and lower boundaries of the enclosed item. The cutter/stacker portion 44 then stacks the separated packages in the magazine 200. The cutter/stacker portion 44, although shown as a single portion 44 at the same location, could also be separate members and could be positioned at different locations. The magazine 200 is shown and described in more detail in FIG. 7 and is preferably removable such that when the magazine 200 is filled it can be removed and replaced with an empty magazine.

A rear view of the bulk packaging machine 20 is shown in FIG. 3, illustrating a main drive motor 58 which operates a feed drive 61. The feed drive 61 controls the delivery of each item to be enclosed by the packager portion 41. Also shown are a pair of control boards, including a main circuit board 54*b* and a printer circuit board 54*a,* associated with the control unit 26 and the printer 29, respectively. A power supply connector 51 is provided for connecting the bulk packaging machine 20 to an AC power source. At the lower left portion of FIG. 3, the rear portion of the magazine 200 can be seen extending upwardly towards the cutter/stacker portion 44.

Figure 4:
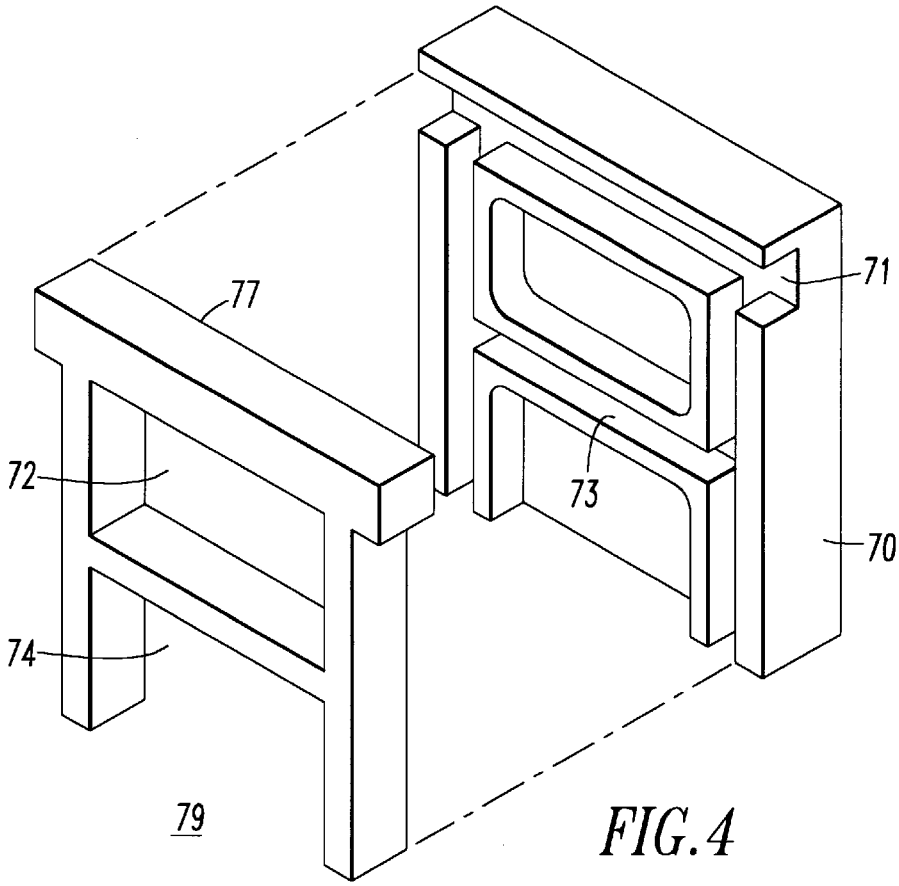
FIG. 4 is an exploded view of a presently preferred embodiment of a package closure die set used in the embodiment shown in FIGS. 2 and 3.

Referring to FIGS. 2 and 4, the closure portion 45 includes a die set such as fixed die or seat member 76 and movable die or closure head 70, which are employed to join the two strips of packaging material 32, 35 together about the item, thereby enclosing the item in a package. Each die 70 and 76 can be fashioned with an intermediate portion 73 as shown on die 70 in FIG. 4. As can be seen in FIG. 2, the dies 70 and 76 are disposed opposite each other with a gap therebetween through which the two strips of packaging material 32, 35 are fed in an adjacent relationship in order to be sealed together by the closure portion 45. The dies 70 and 76 are appropriately sized such that when the movable die 76 is moved against the fixed die 70, the dies 70 and 76 contact each other along mating surfaces thereof. When the two strips of packaging material 32, 35 are placed between the mating surfaces they are thereby joined together along the generally horse shoe shape of the dies 70 and 76. To accomplish the joining together of the two strips of packaging material 32, 35, moveable die 76 is heated by heater 47 and the two strips of packaging material 32, 35 are selected such that the heat causes the two packaging strips to be joined together. Preferably, the stationary die 70 is not heated. We prefer to provide a cavity 71 in die 70 that receives a gasket 77. The strip of packaging material is pressed against the gasket 77 as movable die 76 closes against die 70.

The closure member is selectively configurable to enclose a single packaged item in a larger package 220 with a hole 224 punched in the package, shown in FIG. 8, or generally twice as many smaller packages 230 which do not have a hole, as shown in FIG. 9. Essentially, the larger package 220 is two smaller packages, one filled and one empty, and the hole is punched in the empty package. The selection is made by making an adjustment to a portion of the hole punch driving mechanism 100 in a manner described in detail below in connection with the description of FIG. 6. Additionally, operation of tray 23 is adjusted to control the rate at which product is fed between the packaging material 32, 35 positioned within the closure portion 41. Initially, the packaging material 32, 35 is fed through the closure portion and the die set 70, 76 are operated to seal the material together. At this point no item has been dispensed yet. Thus, only the bottom side of the next package has been sealed. In the next step, an item is dispensed between the packaging material 32, 35 and the packaging material 32, 35 is then fed a certain distance. The dies 70 and 76 are closed, this time sealing the other three sides of the package thereby completely enclosing the item. The distance the packaging material 32, 35 is fed depends on whether or not it is desired to produce the large package 220 or the small package 230. If small packages are being filled, the distance the packaging material 32, 35 is fed after the item is dispensed therebetween is only the distance required to position the item in an upper enclosure region 72, between the top of the die set 70, 76 and the intermediate portion 73. When the dies 70, 76 are then brought together, the top of the dies and the sides thereof completely enclose the item within the upper enclosure region 72 shown in FIG. 4. However, if a hole is to be punched in the package, the packaging material 32, 35 is fed farther, generally twice the distance as the material was moved to create the small package, such that the dispensed item is positioned below the intermediate portion 73 in a lower enclosure region 74. In this case the intermediate portions 73 and the side of the dies 70, 76 below the intermediate portions 73 will seal completely around the item in the lower enclosure region 74. Moreover, the top of the dies 70, 76 and the sides thereof above the intermediate portions 73 will also seal about the upper enclosure region 72. In this case, a hole will be punched in upper region 72 by the hole punch portion 80. The distance the packaging material 32, 35 is moved, in relation to dispensing the items and operation of the closure portion 41, can be controlled by the speed at which the packaging material 32, 35 is fed.

Figure 5:
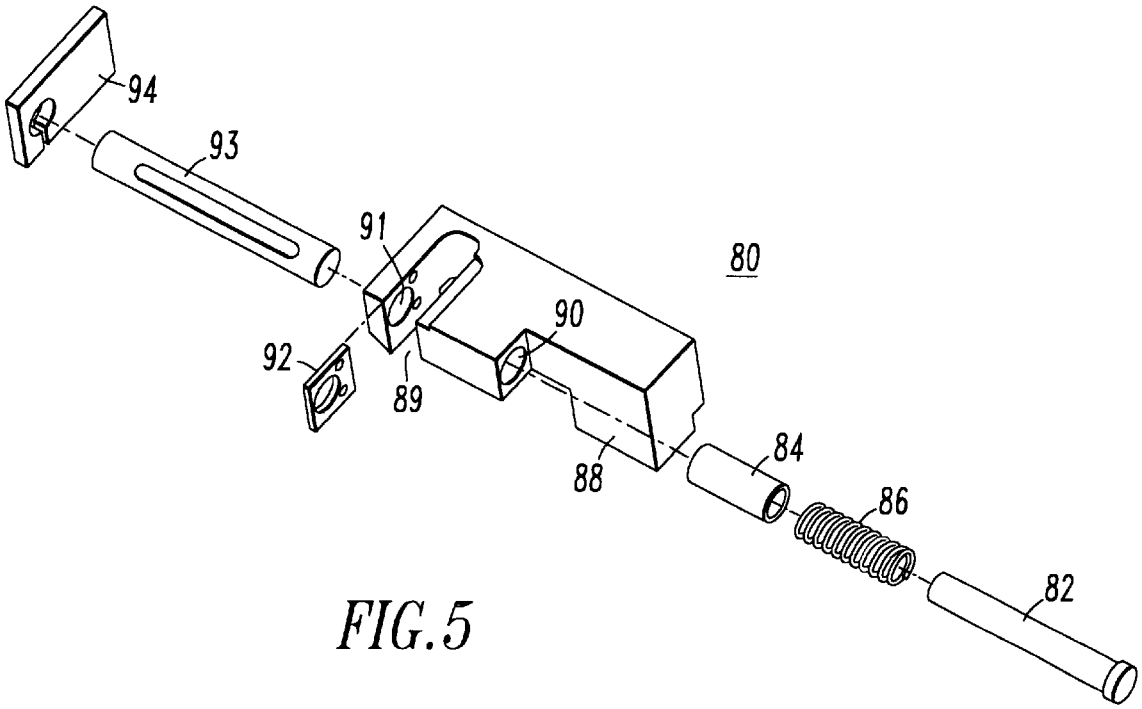
FIG. 5 is an exploded view of a presently preferred embodiment of a hole punch used in the embodiment shown in FIGS. 2 and 3.

In addition to the conventional hole punch portion, a hole punch portion 80 according to the invention, as shown in FIG. 5, preferably includes a linkage in the drive mechanism 100, shown in FIG. 6, which prevents damage to components of the punch portion 80 and drive mechanism 100 if resistance is encountered by the punch 82 member. The hole punch portion 80 of the packaging portion 41 can also include a punch guide block 88 and a plate 94 containing slug tube 93 which receives the punched out portion of the package. The sealed adjacent strips of packaging material 32, 35 are fed between block 88 and tube 93. The punch 82 is aligned with a guide hole 90 in a punch guide block 88 for driving movement therethrough in order to punch a hole though the portion of the two strips of packaging material 32, 35 as they are fed past the punch guide block 88. A sleeve 84 and return spring 86 may be positioned over the punch 82 in order to retract the punch 82 once it has been driven through the guide hole 90 to punch a hole in a package. Additionally, a die plate 92 can be provided in the opening 89 in alignment with a second guide hole 91 to further facilitate the punching of the hole through the two strips of packaging material 32, 35.

The punch driving mechanism, shown in FIG. 6, includes a drive arm 107 which has seat 113 that engages the head of the punch 82 shown in FIG. 5. The main drive arm 107 is attached to moving mounting block 108 by bolt 111 and through slot 114. The mounting block 108 is connected to one of the sealing dies. The pin 110 captured in the slot 106 of the clip portion 105 attaches driving arm 102 to arm 107. Arm 102 has two slots 103 and 104 either of which can be used to connect arm 102 to pin 112. As pin 112 reciprocates arm 102 moves back and forth causing arm 107 to reciprocate. When arm 102 is engaged to pin 112 through slot 104, seat 113 will engage punch 82 pushing to forward as arm 107 advances. As arm 107 moves backward, spring 86 returns the punch to its original position. According to a preferred embodiment of the invention, arm 102 is made of a plastic such as Delrin plastic. The slot 106 and clip portion 105 are designed to flex and permit the pin 110 to disengage, by spreading the clip portion 105 enough to release the pin 110 from the slot 106, in the event that a certain degree of resistance is met by the punch 82 during the hole punching operation. In this manner, instead of any components breaking, the arm 107 driving punch 82 simply disengages from the punch driving arm 102. The only repair necessary to resume packaging is to reengage the pin 110 with the driving arm 102 by reinserting the pin 110 into the slot 106 in the clip portion 105. The setting in slot 104 is used when making the large package shown in FIG. 8 which is punched.

To make the small package of FIG. 9, one moves arm 102 so that pin 112 is in slot 103 in the forward portion of the punch driving arm. As a result, the bottom of arm 102 will have been moved rearward such that seat 113 will not contact driving punch 82. By positioning pin 112 in slot 103, the seat 113 on arm 107 either never engages the punch 82, or if it does engage the punch, the result is that the punch 82 is not moved forward sufficiently to reach the package when it is operated and thus no hole will be punched through the package.

Figure 7:
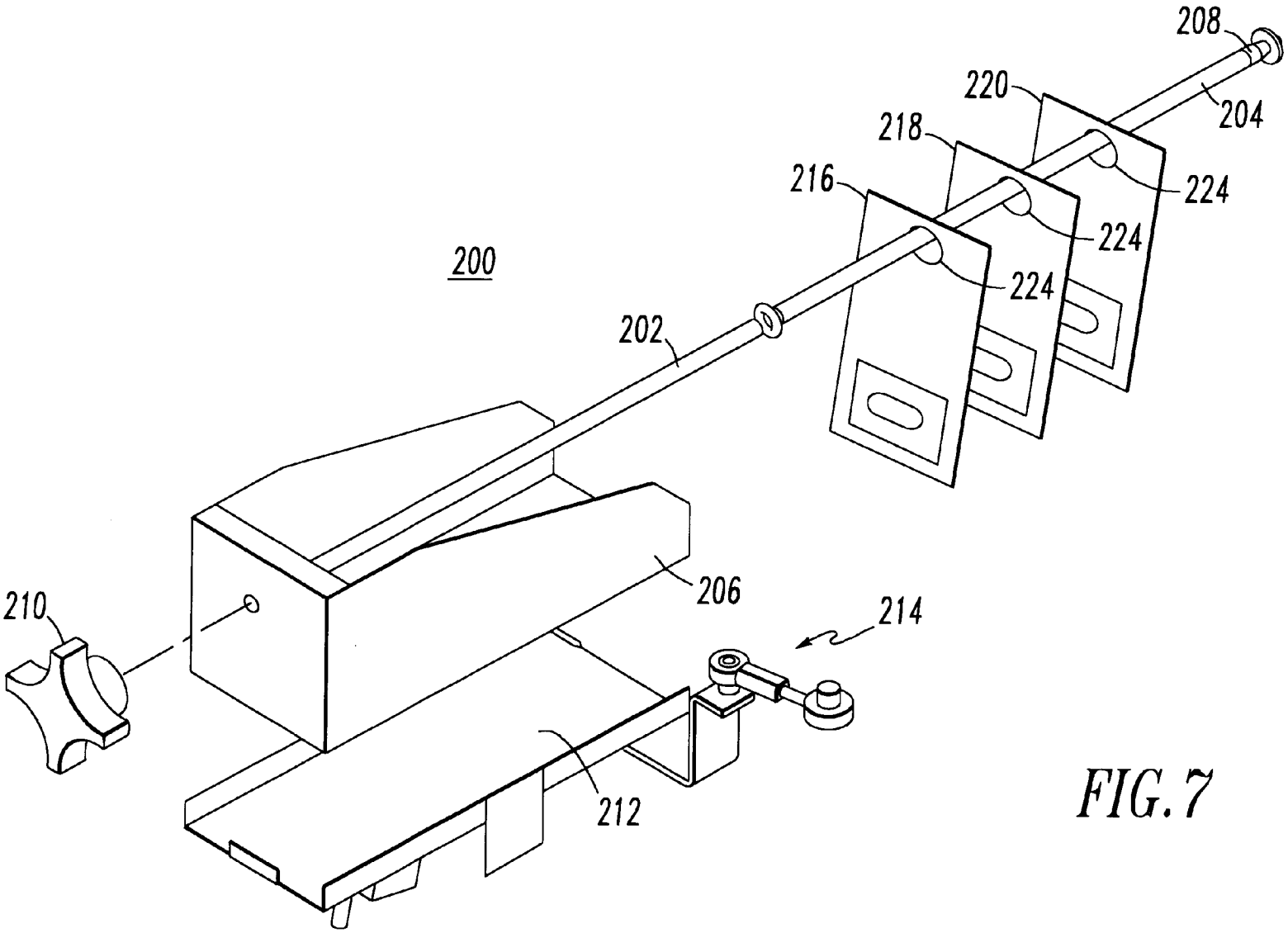
FIG. 7 is an exploded view of a presently preferred embodiment of a magazine.

A presently preferred embodiment of a magazine 200 is shown in FIG. 7 having a rod 202 adapted to removably receive a rod tube 204 thereover. The rod tube 204 can have a specially configured tip member 208 which is designed to facilitate the insertion thereover of individual packages, such as packages 216, 218, 220, via a hole 224 punched in each package 216–220. The magazine 200 includes a housing 206 and a handle 210. The housing 206 is received in a tray 212 which is attached to the bulk packaging machine 20. A plurality of packages, such as packages 216–220, can be disposed into the magazine 200 over the configured tip member 208 and stored on the rod tube 204. When filled with packages, the rod tube 204, with the packages held thereon, can be removed from the magazine 200 simply by slipping the rod tube 204 off of the rod 202. An empty rod tube 204 may then be placed over the rod 202 and the magazine 200 can then be refilled with packages. In this manner, the bulk package machining 20 can enclose, separate and stack multiple packages of items almost continuously, multiple packages of items almost continuously, while storing them in the magazine 200 on the rod tube 204 which can be removed when filled and replaced with an empty rod tube 204.

Additionally, a linkage 214 is preferably provided which attaches the tray 212 to the bulk packaging machine 20. The linkage 214 is designed to permit the tray 212, which holds the magazine housing 206, to pivot allowing the packages to drop from the machine rather than be loaded onto tube rod 204. This is particularly useful during set-up of the machine. These packages could be left over from the previous packing run and are the ones between printer 29 and cutter 44. This makes it faster and easier to remove the rod tube 204, with the packages thereon and to replace an empty rod tube 204 back over the rod 202 so that the magazine 200 may be refilled. In addition, this action allows a number of packages to be purged.

Although the strips of bulk packaging material 32, 35 are shown as being generally flat, it should also be understood that one or both of the strips of packaging material 32, 35 could have contours or raised portions. Accordingly, packages produced by the bulk packaging machine 20 could be blister packages having sloped raised formations as described in U.S. Pat. No. 5,878,885. Furthermore, the height of the blister or raised portion surrounding the pill or capsule within the package will vary among different medications. For example, an 800 mg Ibuprofen tablet is much larger than a 200 mg Ibuprofen tablet. Accordingly, the number of packages that can be held on the rod tube 204 may differ according to what is being packaged. We prefer to provide software within the control unit 26 having a selector such as knob 16 that allows the operator to enter or select the type of medicine being packaged. Once that selection is made, the software will determine the number of packages of that medicine that can be held on the rod tube. That determination is based upon the thickness of each package which depends upon the thickness of the selected medicine and the length of the tube rod 204. The software can also determine the size package to use. The information may be in a look-up table. The software further enables the controller to count the packages as they are being made, signal when the tube rod 204 is full or nearly full and stop the packages when sufficient packages have been made to fill the tube rod. Then, the operator removes the packages from the tube rod or replaces the filled rod with an empty rod and restarts the packager.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. In a packaging machine for enclosing items in a package by delivering the item through a feeder that disposes the item between two strips of packaging material which are then joined together around the item by a closure member thus sealing the item in an individual package, the packaging machine further demarcating upper and lower boundaries about the item such that the individually packaged item may be separated from a continuously produced strand of separable packages, the improvement comprising:

a. a hole punch portion adjacent at least one of said package and said joined together strips of packaging material for punching a hole therethrough;

b. a separating portion adjacent said strand of separable packages for separating said strand of separable packages into separated packages;

c. a stacking portion in communication with said separated packages; and d. a magazine adjacent said stacking portion, said magazine having a rod member on which said stacking portion disposes said separated packages via said hole provided by said hole punch portion.

2. The packaging machine of claim 1 wherein said hole punch portion is selectively operable to punch said holes.

3. The packaging machine of claim 1 further comprising:

a. a punch member having a tip end at one end for punching a hole having a head at the opposite end;

b. a punch driving arm having a seat which can releasably engage said head of said punch member to urge said punch member forward to punch said hole; and c. a reciprocating drive pin connected to said punch driving arm.

4. The packaging machine of claim 3 further comprising a linkage connected between said punch driving arm and said drive pin; said linkage responsive to a predetermined degree of resistance met by said punch member when said punch driving arm urges said punch member forward to punch said hole such that said linkage arm will respond by releasing said punch driving arm.

5. The packaging machine of claim 4 wherein said linkage is selectively operable and further comprising:

a. said linkage being an elongated body having a first end releasably connected to the punch driving arm and having a second end, said second end having a front slot and a rear slot;

b. said linkage being selectively movable to position the drive pin in a selected one of the first slot and the second slot.

6. The packaging machine of claim 1 wherein said magazine is removable.

7. The packaging machine of claim 1 further comprising a linkage pivotably connecting said magazine to a housing portion of said packaging machine such that said magazine is pivotable away from said packaging machine to facilitate removal of said packages.

8. The packaging machine of claim 1 further comprising:

a. a rod tube disposed within said magazine, said rod tube slidably disposed over said rod member in a removable manner; and b. said separated package disposed in said magazine onto said rod tube via said hole and said rod tube is removable from said rod member and said magazine with said separated packages thereon.

9. The packaging machine of claim 8 further comprising said rod tube having a tip member configured to facilitate disposing said separated packages onto said rod tube.

10. The packaging machine of claim 8 further comprising a linkage pivotably connecting said magazine to a housing portion of said packaging machine such that said magazine is pivotable to facilitate removal and insertion of said rod tube over said rod member.

11. The packaging machine of claim 1 further comprising a printer positioned for printing indicia on at least one side of at least one of said two strips of packaging material, said indicia providing information regarding said enclosed item.

12. The packaging machine of claim 1 wherein said item is medicine.

13. The packaging machine of claim 1 further comprising a control unit, the control unit having a selector for identifying medicine to be packaged and containing a program which determines how many packages of a selected medicine can be held on the rod member, counts packages being made and notifies an operator when a determined number of packages have been made.

14. The packaging machine of claim 13 wherein the program notifies the operator by stopping the packaging machine.

15. A packaging machine for enclosing items comprising:

a. a first supply of a first strip of packaging material;

b. a second supply of a second strip of packaging material;

c. a feeder for drawing each of said first and second strips of packaging material into an adjacent relationship;

d. a chute positioned to receive at least one of said items to be enclosed, said chute delivering said item to a point between said adjacent first and second strips of packaging materials;

e. a packaging portion in communication with said point where said item is delivered, said packaging portion joining said first and second strips of packaging material together about said item to form a package;

f. a hole punch portion adjacent at least one of said package and said joined together strips of packaging material for punching a hole therethrough;

g. a demarcating portion for demarcating upper and lower boundaries about each said package to form a strand of separable packages;

h. a separator positioned adjacent said strand of separable packages which separates said strand of separable packages into individual separated packages;

i. a stacking portion in communication with said separated packages; and j. a magazine adjacent said stacking portion, said magazine having a rod member on which said stacking portion disposes said separated packages via said hole provided by said hole punch portion.

16. The packaging machine of claim 15 further comprising:

a. a punch member having a tip end at one end for punching a hole having a head at the opposite end;

b. a punch driving arm having a seat which can releasably engage said head of said punch member to urge said punch member forward to punch said hole; and c. a reciprocating drive pin connected to said punch driving arm.

17. The packaging machine of claim 15 further comprising a linkage connected between said punch driving arm and said drive pin; said linkage responsive to a predetermined degree of resistance met by said punch member when said punch driving arm urges said punch member forward to punch said hole such that said linkage arm will respond by releasing said punch driving arm.

18. The packaging machine of claim 17 wherein said linkage is selectively operable and further comprising:

a. said linkage being an elongated body having a first end releasably connected to the punch driving arm and having a second end, said second end having a front slot and a rear slot;

b. said linkage being selectively movable to position the drive pin in a selected one of the first slot and the second slot.

19. The packaging machine of claim 15 wherein said magazine is removable.

20. The packaging machine of claim 15 further comprising a linkage pivotably connecting said magazine to a housing portion of said packaging machine such that said magazine is pivotable away from said packaging machine to facilitate removal of said packages.

21. The packaging machine of claim 15 further comprising:

a. a rod tube disposed within said magazine, said rod tube slidably disposed over said rod member in a removable manner; and b. said separated package disposed in said magazine onto said rod tube via said hole and said rod tube is removable from said rod member and said magazine with said separated packages thereon.

22. The packaging machine of claim 21 further comprising said rod tube having a tip member configured to facilitate disposing said separated packages onto said rod tube.

23. The packaging machine of claim 21 further comprising a linkage pivotably connecting said magazine to a housing portion of said packaging machine such that said magazine is pivotable away from said packaging machine to facilitate removal and insertion of said rod tube over said rod member.

24. The packaging machine of claim 15 further comprising printing indicia on at least one side of at least one of said first and second strips of packaging material, said indicia providing information regarding said enclosed item.

25. The packaging machine of claim 15 wherein said item is medicine.

26. The packaging machine of claim 15 further comprising a control unit, the control unit having a selector for identifying medicine to be packaged and containing a program which determines how many packages of a selected medicine can be held on the rod member, counts packages being made and notifies an operator when a determined number of packages have been made.

27. The packaging machine of claim 26 wherein the program notifies the operator by stopping the packaging machine.

* * * * *